US005618044A

United States Patent [19]

Bateman

[11] Patent Number: 5,618,044

[45] Date of Patent: Apr. 8, 1997

[54] BULLET TRAP AND CONTAINMENT CAVITY

[76] Inventor: Kyle E. Bateman, P.O. Box 636, Provo, Utah 84603-0636

[21] Appl. No.: 315,552

[22] Filed: Sep. 30, 1994

[51] Int. Cl.[6] ..... F41J 1/12

[52] U.S. Cl. ..... 273/410

[58] Field of Search ..... 273/410

[56] References Cited

U.S. PATENT DOCUMENTS

| | | | |
|---|---|---|---|
| 2,013,133 | 9/1935 | Caswell | 273/410 |
| 2,772,092 | 11/1956 | Nikoden | 273/410 |
| 3,701,532 | 10/1972 | Nikoden | 273/410 |
| 3,737,165 | 6/1973 | Pencyla | 273/410 |
| 4,126,311 | 11/1978 | Wagoner | 273/410 |
| 4,164,901 | 8/1979 | Everett | 273/410 X |
| 4,458,901 | 7/1984 | Wojcinski | 273/410 |
| 4,470,604 | 9/1984 | Hoffmann | 273/410 X |
| 4,512,585 | 5/1985 | Baravaglio | 273/410 |
| 4,821,620 | 4/1989 | Cartee et al. | 273/410 X |
| 5,040,802 | 8/1991 | Wojcinski et al. | 273/410 |
| 5,070,763 | 12/1991 | Coburn | 273/410 X |
| 5,088,741 | 2/1992 | Simonetti | 273/410 |
| 5,113,700 | 5/1992 | Coburn | 273/410 X |
| 5,121,671 | 6/1992 | Coburn | 273/410 X |
| 5,171,020 | 12/1992 | Wojcinski | 273/410 |
| 5,259,291 | 11/1993 | Wilson | 273/410 X |
| 5,400,692 | 3/1995 | Bateman | 273/410 X |

*Primary Examiner*—William H. Grieb

[57] ABSTRACT

A Bullet Trap and Containment Cavity which can be assembled as a modular system, requires very little space for installation on a typical shooting range, and which stops impacting projectiles by an initial, generally perpendicular impact on a steel plate and then utilizes auxiliary impact surfaces to contain the resultant splatter zone projected from the initial point of contact. Small fragments which might otherwise escape the auxiliary impact surfaces can be contained by the addition of an optional permeable curtain over the front aperture of the trap. Lead fragments and other residue may be collected by an optional containment bin or conveyor system at the base of the trap. Other options allow active removal of minute, airborne particulates in the air contained within the trap cavity.

21 Claims, 4 Drawing Sheets

BULLET TRAP AND CONTAINMENT CAVITY

BACKGROUND

1. The Field of the Invention

The present invention relates generally to apparatus for deceleration of projectiles, and containment of those projectiles and their fragments and particulates resulting therefrom. More particularly, it concerns apparatus in which an impacting projectile is fragmented, its forward momentum mostly stopped but partially reflected into a generally predictable splatter zone which is then confined by successive impact plates in a partially or completely contained cavity. The bullets, fragments and resulting particulate matter are then collected and confined for disposal or recycling.

2. The Background Art and Background of the Invention

It is understood that when a projectile such as a bullet strikes an object, the original energy of the projectile, which is conserved, will be transformed into one or more of several other forms including: deformation of the projectile, deformation of the object, reflected motion of the projectile, and reflected motion of the object.

When the object of sufficient inertia to retain its original momentum after the impact of a bullet, and the object is composed of a material possessing sufficient strength and other resiliency to resist significant deformation from the impact, an analysis of the impact may reasonably be restricted to the effects upon the bullet, including both deformation and reflected motion.

The term "reflected motion" is used broadly herein and refers to the new, changed momentum vector of a projectile which is a result of an impact with an object. The terms "bullet" and "projectile" are used broadly and interchangeably herein. They refer to the original body as placed in motion, as well as any fragments or particulate matter formed as a result of impacts with another object.

When the object being struck is a planar surface (a plate) and meets the high-inertia, high-strength criteria described above, the resultant reflected motion can be readily described in terms of two characteristics: exit zone, and bullet integrity. These quantities are generally related to several variables, among which some of the most significant are bullet composition, angle of incidence, and bullet velocity. Assuming a relatively constant range of both bullet compositions and bullet velocities, a relevant analysis can be derived from the angle of incidence alone.

When a bullet strikes a plate at an extremely low angle, close to 0 degrees, the bullet integrity remains essentially intact. The exit zone is also changed very little from the angle of incidence, generally running generally parallel to the surface of the plate.

As the angle of incidence is increased, the most notable effect is that the bullet begins to lose a small part of its integrity as it exits the point of impact. Because the projectile can no longer be characterized as a point, it is most helpful to analyze the now multiple exit trajectories as a zone. At relatively low angles, approximately from 0 to 25 degrees most of the fragmented matter from the bullet continues to travel in roughly the same direction as the main body of the bullet. However as the angle is continually increased, the zone begins to more closely resemble a fan shape, emanating radially from the point of impact in something generally less than a 180 degree spread.

An additional result of increasing the angle of incidence is that the exit angle, in relationship to the surface of the plate begins to increase slightly as well. It is generally not complementary to the angle of incidence as it would be in an analysis of a more elastic media. Rather, the exit angle tends to range from 0 to 20 degrees as some function of the angle of incidence, which ranges from 0 to 90 degrees.

As the angle of incidence is increased above 45 degrees, another effect begins to become evident. The fan shape of the exit zone begins to spread to angles generally greater than 180 degrees, the effect of which is that, given sufficient angle of impact, the zone begins to resemble a cone whose pinnacle is at the point of impact and whose sides extend outward from that point at the exit angle (see FIG. 4).

As the angle of incidence begins to approach 90 degrees, this effect, in combination with the increasingly complete destruction of the bullet integrity at high impact angles produces an exit zone which is almost entirely composed of extremely low-mass fragments, and forms a uniform, relatively predictable cone shape.

Target practice is an activity pursued by many to enhance shooting skills, as criteria of employment, or for sport. It is customary in target practice to provide a means of stopping projectiles after they have traveled through or by a target, and before their potential to harm persons or damage property is concluded. This is traditionally accomplished by such means as providing adequate proximity between the target and persons and property or by constructing a barrier such as an earthen berm or a wall to stop the path of the projectile. In light of modern weapons with long and powerful trajectories, proximity solutions involve massive amounts of valuable land resources and are therefore often unfeasible in all but the most remote areas.

Merely providing an earthen or other barrier may stop the bulk of the projectiles, but has no effect on the indiscriminate distribution of lead, the primary material used for bullets, into the environment. Lead is a heavy metal environmental contaminant increasingly implicated as a health risk to humans and animals.

Simple barriers may stop a projectile, but allow lead fragments or particulates to escape into the environment. Barriers without containment deflect bullets which may retain enough energy to harm bystanders, shooters, or property. Thus, these solutions still require a significant, additional proximity solution.

The term "plate" is used herein in its broadest sense as a planar sheet of material capable of stopping or deflecting a projectile and its fragments. It will be understood by those of ordinary skill in the art, that selection of plate material is made in consideration of the nature and velocity of the various projectiles to be stopped and contained. For most firearms, the material of choice may be hardened steel plate or the equivalent. Furthermore, plates intended to take primary, direct impacts will necessarily be stronger than those intended to take secondary or tertiary impacts.

For purposes of technical description, the terms "front," "back," "side, " "top" "bottom," etc shall be used as they relate to the perspective of a shooter firing a projectile into the bullet trap.

Recent emphasis has been placed on stopping and containing projectiles by the use of bullet traps and stops, and containment systems employing a variety of configurations intended to stop a projectile and contain the resultant products. For example, in U.S. Pat. No. 4,821,620, to Cartee et al. (1989), it is described to provide a screen of rubber-like material followed by a deflector plate. The bullet is said to travel through the screen and be diverted by the plate down toward the collector bin at the base of the device. The close proximity of the rubber-like material to the plate, combined with the angle at which the plate is disposed, produce the particular disadvantage of exposing the rubber-like material to relatively high-energy reflections of the bullet off the plate, therefore causing the material to quickly wear out and/or to allow bullets to escape back through the screen with enough energy to cause harm to persons or property.

Others including Baravaglio in U.S. Pat. No. 4,512,585 (1985), and Pencyla in U.S. Pat. No. 3,737,165 (1973), and Nikoden in U.S. Pat. No. 2,772,092 (1954), describe systems consisting of a collection of impact plates oriented at angles to the trajectory of the bullet which direct the bullet, relatively intact, backward or downward into an area where it is decelerated in some sort of generally rounded chamber. The curved plates, the number of plates and the need for a variety of other fabricated components make these devices generally expensive to manufacture, assemble, and service. Additionally, these devices generally suffer the disadvantage that bullet accumulations in the collection bins are not easily accessible to the user to facilitate removal of the lead.

Others including Wagoner in U.S. Pat. No. 4,126,311 (1978), and Coburn in U.S. Pat. No. 5,070,763 (1991), and this inventor, Bateman, in my co-pending U.S. patent application Ser. No. 08/204/682, have more effectively dealt with the problem of lead removal by describing long, generally funnel-shaped openings which direct projectiles through a relatively small aperture where they enter a containment chamber and are decelerated by one method or another. All these and similar devices require large quantities of plate material in order to form the relatively low angles required to guide the bullet into the chamber without destroying its integrity. The depth of such traps often must range from 15' to 40' in order to obtain a typically required vertical front opening of 8' to 10'. The cost of the plate required creates an obvious disadvantage to suppliers competing to produce such apparatus. Furthermore, the amount of space required for the bullet trap is a disadvantage in instances where the cost of land or surrounding facilities should be minimized or in instances where an existing shooting range only has a limited amount of space in which to place the trap.

Another problem yet unsolved by the prior art is containment of fine fragments and particulate matter created on impact without the problems associated with "deep" bullet traps or other complex or expensive arrangements. For example, Wojcinski in U.S. Pat. No. 5,171,020 (1992), describes a device consisting of a back plate and an elastic facing which form a containment chamber which is then filled with a mass of granulated rubber material. In theory, as the bullet passes through the granulated material, its velocity is slowed completely, or significantly enough that any impact with the back plate will not cause damage to the plate or the projectile. While this device appears to solve the containment problem, it can only do so at great cost. Specifically, the volume of granulated material needed in practice tends to be unmanageable. And once the elastic facing becomes destroyed, it must be replaced or repaired. In order to perform this maintenance, all the granulated material must be removed, stored, and then replaced which procedure can be time consuming, expensive, and potentially even dangerous.

W. German Patent 31-31-228 describes a similar device which, rather than granulated rubber, uses rubber-like sheets called "lamellas" hung from above in a pattern parallel to one another, all at an angle to the trajectory of the bullet. As the bullet penetrates the layers of lamellas, eventually its velocity is slowed or stopped. Spent bullets are intended to drop down between the lamellas and to the floor where they can be collected. While this device solves several of the stated problems, in practice, the lamellas soon become worn in the areas of highest bullet concentration. Because the lamellas form the primary deceleration mechanism, in their worn state, they may allow bullets to pass completely through the trap causing an extremely dangerous hazard to persons or property behind the trap.

In short, all known prior art employs a variation of one of two fundamental deceleration methods: 1) to use plates oriented at relatively low angles to the trajectory of the bullet and thereby direct the bullet, somewhat intact, into successively more controllable trajectories; or 2) to use a permeable material which gradually decelerates the projectile, but suffers its own partial destruction in the process.

Those having ordinary skill in the art will appreciate that the present invention is therefore unique and also meets the outlined needs as well as needs not specified herein.

OBJECTS AND SUMMARY OF THE INVENTION

It is therefore an object of the present invention to provide a bullet trap and containment cavity with a defined containment cavity into which bullets may readily pass and inside of which they will be contained.

It is an additional object of the invention to provide such bullet trap and containment cavity which will require a minimum of floor space for installation and use.

It is an additional object of the invention to provide such bullet trap and containment cavity which can be constructed from flat plates and other relatively inexpensive and readily available materials.

It is an additional object of the invention to provide such bullet trap and containment cavity which will convey lead particulates into a collector which may be easily accessed for cleaning and lead removal.

It is an additional object of the invention to provide such bullet trap and containment cavity which can be easily assembled and serviced on site.

It is an additional object of the invention to provide such bullet trap and containment cavity which can be interconnected with similar units in an array,to create larger bullet traps of any required size.

The above objects and others not specifically recited are realized in a specific illustrative embodiment of a bullet trap and containment cavity for arresting the inertial momentum of projectiles traveling in a generally horizontal direction. Projectiles enter the containment cavity through an aperture which is facing the shooter. The aperture is rectangular and only slightly smaller than the trap itself. Errant shots which are either too low or too high to directly enter the aperture are deflected by plates which then direct the bullet properly through the aperture.

The containment cavity consists of a back plate which is generally perpendicular to the bullet trajectory, side plates which separate adjacent, like trap modules and which form secondary impact surfaces, a top plate which combines with the other structure to form a partially confined cavity, a bottom plate which, in addition to forming the cavity, also serves to convey lead fragments downward into the collection device, and tertiary impact plates which serve to contain any bullet fragments which might otherwise reflect off the secondary surfaces and back toward the shooter.

When the bullet strikes the back plate, it is immediately fragmented into many small components which begin to reflect from the point of impact in the generally predictable conical pattern previously described. As this pattern spreads out, it eventually encounters all of the secondary impact surfaces: the sides, top and bottom. As each fragment impacts these surfaces, the process of splattering into a conical pattern is essentially repeated, but on a smaller scale, and at the point of impact of each such fragment. However, due to the greatly decreased energy present in the smaller particles and the somewhat decreased angle of incidence, the pattern is largely biased toward the direction from whence the bullet originally emanated (toward the shooter). As these secondary patterns spread out, the resultant particles eventually strike the tertiary impact surfaces, preventing their travel back toward the firing area. If any more conical patterns are generated at this point, they are reflected back into the containment area for further reflections. However, empirical data shows that very little bullet matter retains any significant energy after the tertiary impact.

As bullet particles lose their inertia, they either fall immediately to the bottom of the containment cavity or they remain airborne for some time before finally coming to rest on the bottom plate. In practice, generally due to small surface or other imperfections, there are a very small portion of the particles which do not tend to behave in the predicted manner. As a result, some of these particles can be reflected back out the trap aperture. Although the energy contained in such particles is seldom sufficient to pose a risk to persons or property, over time, it can be sufficient to cause a lead contamination problem in certain applications where secondary containment is not provided. Therefore, an optional curtain of rubber-like material can be placed over the cavity aperture in those instances where more complete containment is required.

The bullet, on its original trajectory, has sufficient energy to pierce this curtain and enter the containment cavity. The curtain is not effective at effecting the velocity or the trajectory of the bullet. However, once the bullet has fragmented, the resultant reflected particles can not escape back through the curtain. Although the rubber-like curtain does constitute a "wear-out" item, it provides an acceptable alternative in many applications.

Bullet particulates generally migrate by gravity toward the collection area at the base of the trap. This collection device may consist of a simple tray, allowing manual removal of lead during cleaning. Because of the relative elevation of the front edge of the bottom plate to the floor, the collection device can also consist of a standard, automated belt or paddle system to convey the lead waste to one side of the trap where waste lead from the entire range may be collected in a single container.

Those fragment components which are light enough to remain airborne for some time can be handled in several ways: Given enough time in "free air" conditions, all particulates will eventually fall to the bottom of the containment cavity. However, in those applications where surrounding turbulent air or other disturbances may interfere with the normal precipitation of lead particulates, two other options may be added to aid in lead containment.

One option is to dispense an atomized liquid or colloid into the containment cavity from a point near the top of the cavity. Use of such a liquid, in conjunction with the front curtain forms a contained area where the liquid or colloid will attach itself to suspended lead particulates. The increased weight of the combined particles speeds the precipitation process and helps convey lead particulates into the collection area at a greater rate.

A second option, also used in conjunction with the front curtain is to draw a continual rate of air out of the containment cavity. This flow creates a low pressure inside the containment cavity and hence a net flow of air in through any gaps or holes in the cavity or in the front curtain. This flow of air keeps particulates inside the containment area long enough to properly precipitate, or it draws them out through the air outlet where they can be filtered by conventional techniques.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENT OF THE PRESENT INVENTION

Figure 1:
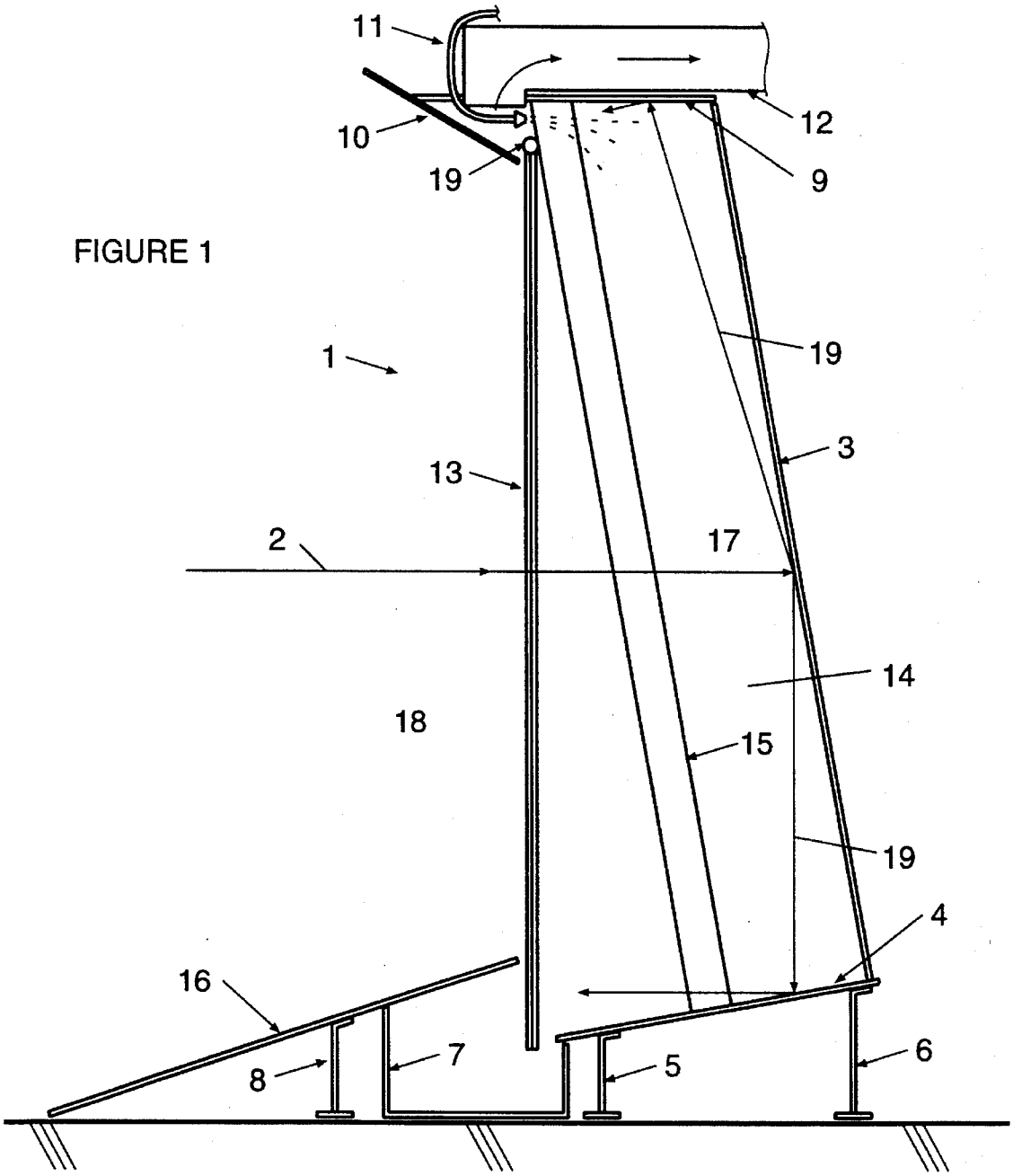
FIG. 1 is a side cross sectional view of a bullet trap and containment cavity made in accordance with the principles of the present invention.

Reference will now be made to the drawings wherein like structures will be provided with like reference numerals.

Referring to FIGS. 1–4, there is shown, generally designated at 1, a bullet trap and containment cavity for stopping the forward momentum of projectiles traveling in a generally horizontal zone of projectile travel 2. The bullet trap and containment cavity comprises generally a back plate 3, side plates 14, top plate 9, bottom plate 4, side deflector 15, top deflector 10, and bottom deflector 16.

The back plate 3 forms the primary impact surface and is rectangular in shape. The bottom edge of this plate is connected to the back edge of the bottom plate 4 which forms the bottom secondary impact surfaces. The bottom plate rests upon front legs 5 and back legs 6 which are of different heights to hold the bottom plate at an angle of ten degrees, and are anchored to the ground by traditional techniques. This slight angle tilts the entire cavity ten degrees toward the shooter which is optimal for two reasons: 1) to mitigate the difference in angle of incidence between those bullets which pass directly into the cavity 17 and those misdirected bullets which first hit the floor or the bottom deflector 16 (yet to be described) before being directed into the cavity 17 (such "low" misdirected bullets are much more common than those impacting above the cavity 17); and 2) to aid in the collection of projectiles which have come to rest on the bottom plate 4. The front legs 5 and the back legs 6 are connected to the bottom plate 4 at its edges, or at the joint with adjacent bottom plates in instances where multiple trap modules are installed side by side.

A normally directed bullet on trajectory 2 will pass into the cavity, striking the back plate 3 and will be reflected outward as previously described, forming the primary conical zone.

At each end of the base plate 4 and the back plate 3 are disposed side plates 14 which are vertical, and generally orthogonal to the base plate 4 and the back plate 3. The slightly obtuse angle of 93 degrees of the side plates 14 with respect to the back plate 3 is optimal in order to: 1) facilitate interconnection of adjacent trap modules; and 2) aid in directing reflected particles in an optimum zone.

These side plates 14 form the two side secondary impact surfaces. At the top edge of each side plate 14 and the back plate 3 is disposed a top plate 9, which forms the upper secondary impact surface, and which is level with the ground to further aid in projecting secondary reflections within the effective realm of the top deflector 10 which forms the upper tertiary impact surface and is attached to the front edge of the top plate 9 which projects forward beyond the front edge of the side plates 14.

Fragments comprising the primary conical zone project out from the initial point of impact until they reach one of the four secondary impact plates: the two side plates 14, the bottom plate 4, and the top plate 9.

Along the front edge of each side plate 14 is disposed a side deflector 15 which is oriented at 45 degrees so that any misdirected bullets which would miss the cavity aperture 18 and strike directly on the edge of the side plate 14 will instead, be directed normally into the trap cavity 17. The complementary sides of these deflectors 15 also form the two side tertiary impact surfaces.

Disposed under the front edge of the bottom plate 4 is the collection tray 7. Disposed over the front edge of the collection tray is the bottom deflector 16 which forms the bottom tertiary impact plate and additionally, on its complementary surface, redirects misdirected bullets into the cavity 17 as previously described. The bottom deflector 16 is supported by the bottom deflector legs 8 which are anchored to the ground by traditional techniques, and are connected to the bottom deflector 16 along the side edges of the plate, or along the joint of adjacent plates where multiple devices are connected side by side.

Along the front edge of the side deflectors 15, and just above the lower edge of the top deflector 10 is disposed the curtain rod 19 by which the optional front curtain 13 may be suspended. The optional front curtain 13 hangs down vertically and extends into the opening between the back edge of the lower deflector 16 and the front edge of the bottom plate 4.

Above the back edge of the top deflector 10 is disposed the optional nozzle and hose assembly 11 through which a liquid or colloidal suspension is forced under pressure into the cavity 17 by a pump (not depicted) or some other apparent means, or means which may become apparent.

Also disposed above the back edge of the top deflector 10 is the optional outlet port whereby cavity air may be drawn out by the optional air duct 12 to create negative air pressure within the cavity. Air drawn off the cavity by this means is passed through an in-line filter (not depicted) or some other apparent means, or means which may become apparent, which will collect any particulate matter present in the air. It will be appreciated that a filter capable of removing the particulate matter desired to be removed, and which is compatible with any liquid or colloid present, and which is compatible in-use with the working capacities of the air pump (not depicted) should be chosen.

Figure 2:
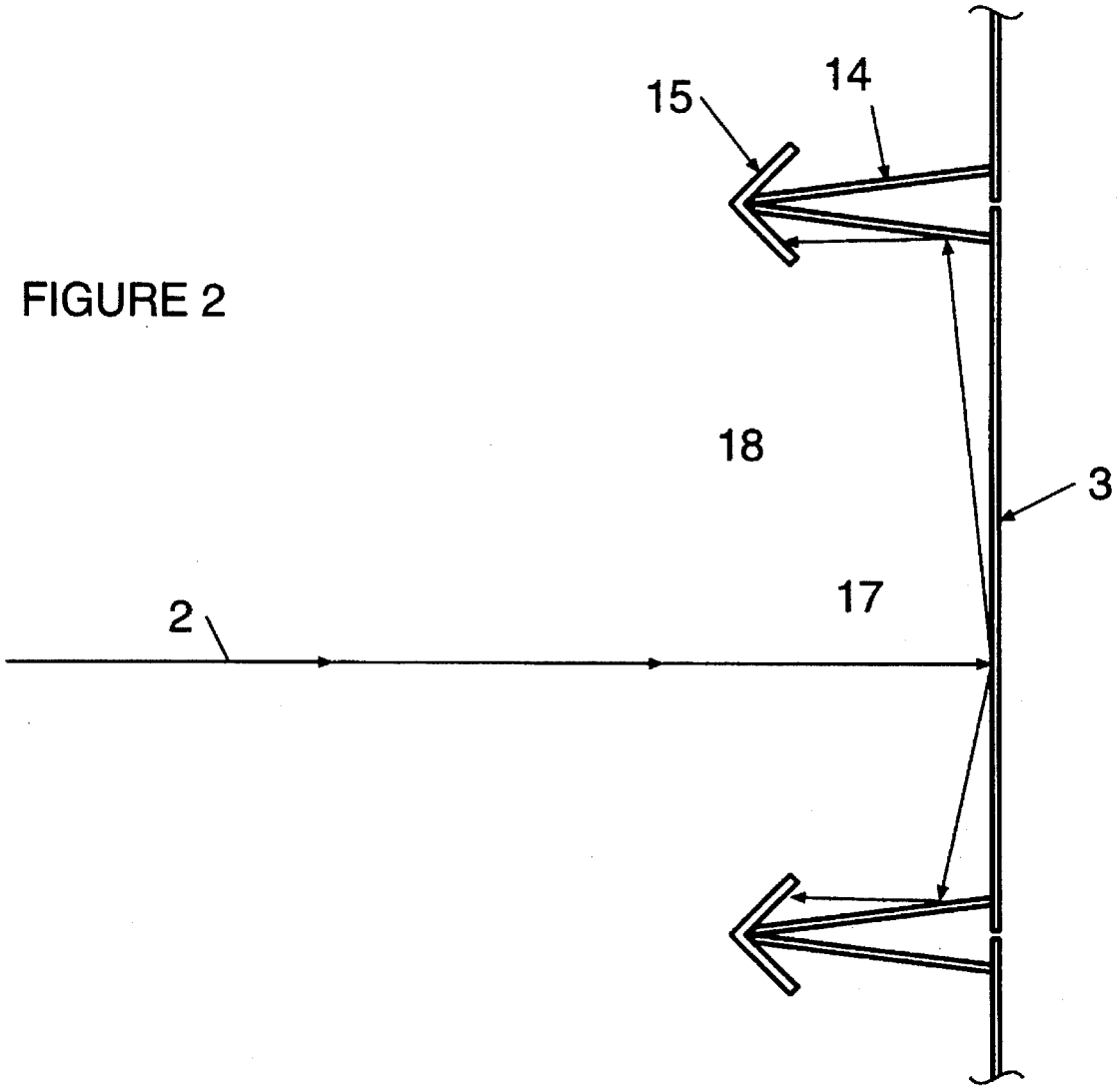
FIG. 2 is a generally overhead, cross sectional view of the back and side members of a bullet trap and containment cavity made in accordance with the principles of the present invention.
Figure 3:
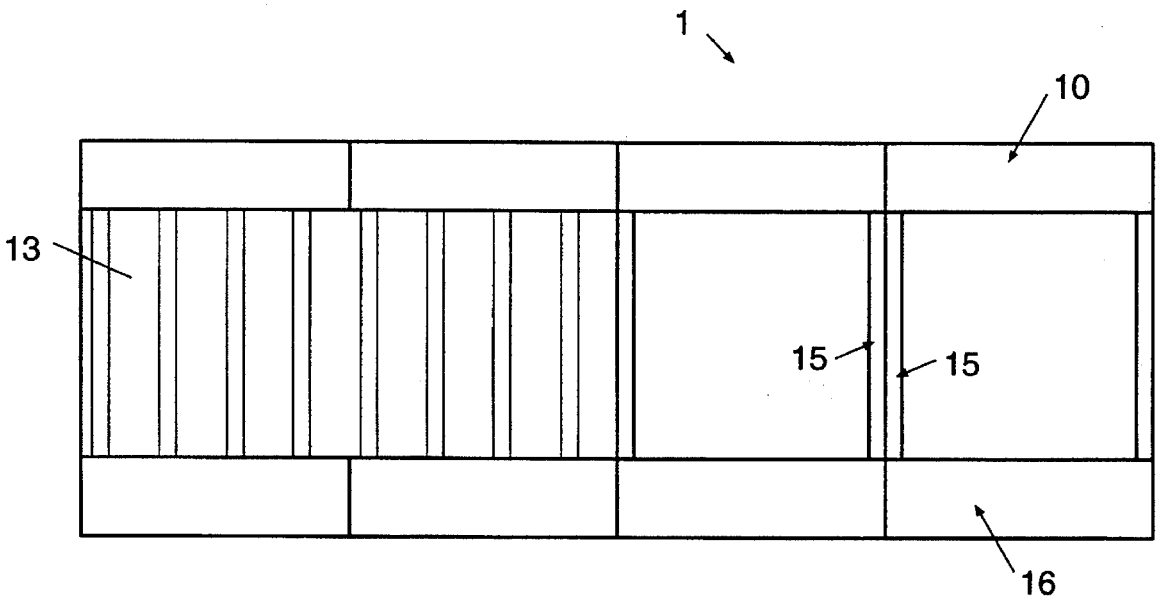
FIG. 3 is a shooter's view of a bullet trap and containment cavity made in accordance with the principles of the present invention wherein the left side is shown with the optional curtain and the right side is shown without.
Figure 4:
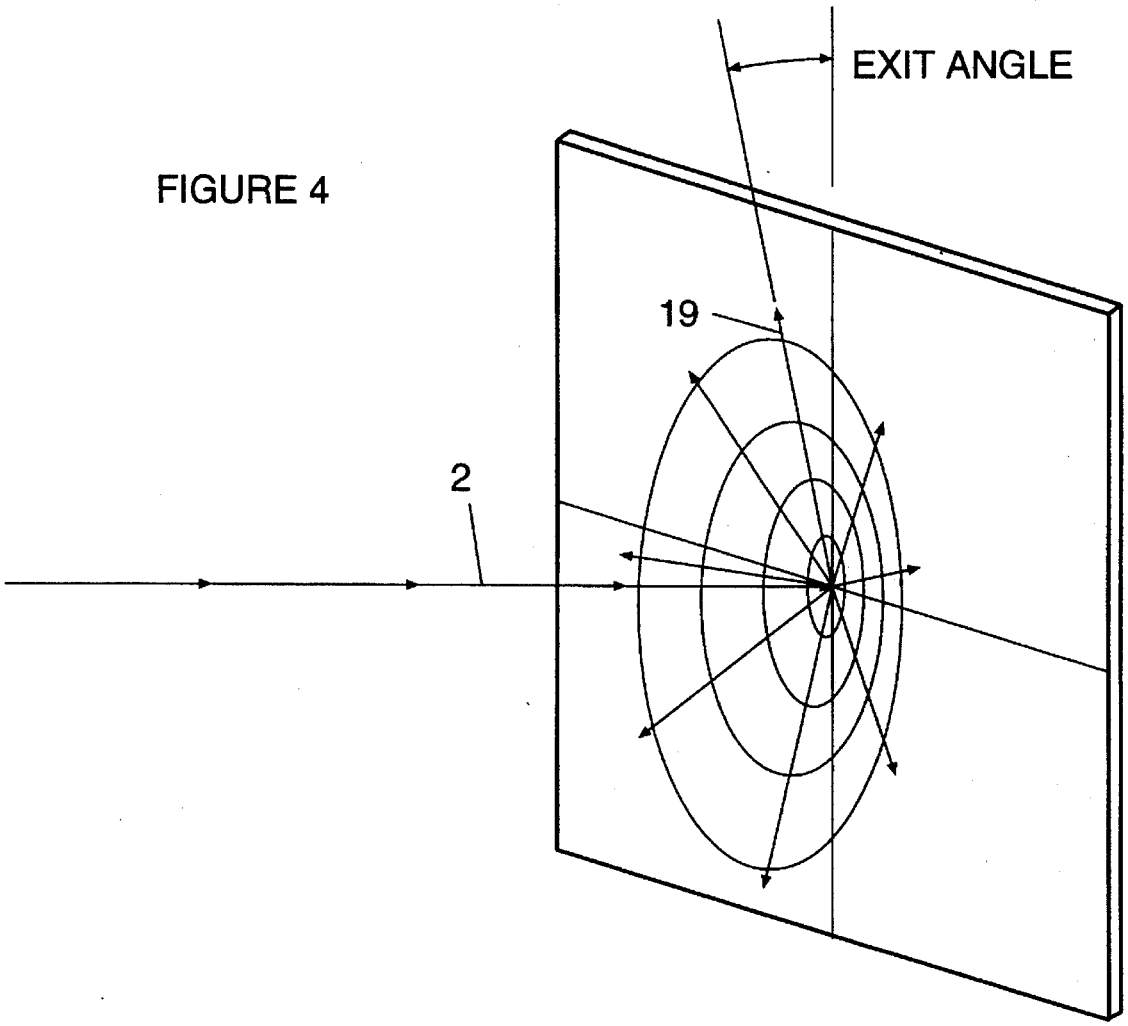
FIG. 4 is an illustrative view of the exit zone of a projectile on a plate as previously described and as it relates directly to the functionality of a bullet trap and containment cavity made in accordance with the principles of the present invention.

In the case of multiple trap modules, installed side by side, as more clearly depicted in FIGS. 2 and 3, adjacent bottom deflectors 16 and adjacent top deflectors 10 join with one another to form a contiguous plane across the length of the assembly. Side deflectors 15 join to one another (see FIG. 2) to form a point by which projectiles will be directed into one cavity or the other. In fact, such adjacent side deflectors 15 are generally formed by an integral piece of formed angle iron to assure greater integrity of the joint and to aid in the fabrication and assembly process.

The plates described are attached to each other by means known in the art, i.e. bolting, clamping, welding etc. Plates may also be interconnected in the original manner described in my co-pending U.S. patent application, Ser. No. 08/008,792, which I adopt and incorporate herein by reference.

The present invention represents a significant advance over conventional bullet trap apparatus. It is noted that many of the advantages of the present invention accrue due to the fabrication of the unit primarily from flat plates and other stock bar types which can be readily purchased, stocked, inventoried, shipped, and fabricated; the unit is readily serviceable; the unit can be installed in a very small space; similar units can readily be interconnected to form a larger array; and the unit has effective means for containing and collecting the by products of projectiles, including fragments and particulate matter. Those skilled in the art will appreciate from the preceding disclosure that the objectives stated above are advantageously achieved by the present invention.

it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A bullet trap and containment cavity for stopping the forward momentum of projectiles traveling in a primary zone of projectile travel, said bullet trap and containment cavity comprising:

primary planar impact means to obstruct the primary zone of projectile travel and fragment projectiles impacting thereon, said fragments reflecting outward in a generally conical zone from the primary point of impact;

secondary planar impact means to obstruct the primary, generally conical zone of projectile travel and further fragment projectiles impacting thereon, said fragments reflecting outward in a secondary generally conical zone from the secondary point of impact;

tertiary planar impact means to obstruct components of said secondary generally conical zone of projectile travel whose trajectories are of a direction as to carry them generally toward the point of origin of the original, integral projectile; and wherein the primary planar impact means, secondary planar impact means, and tertiary planar impact means define the perimeter of cavity means to arrest and contain projectiles, said cavity means having an ingress oriented such that projectiles passing through said ingress in a generally horizontal zone will impact upon said primary planar impact means.

2. A bullet trap and containment cavity as in claim 1 further containing interconnection means whereby multiple like units may be secured together in an array to form a larger total area into which projectiles may be directed.

3. A bullet trap and containment cavity as in claim 1 wherein tertiary planar impact means are oriented such that projectiles missing said cavity ingress and striking the planar surface of said tertiary impact means on the side opposite that used for obstructing tertiary impacts, will be directed toward the ingress of said cavity means.

4. A bullet trap and containment cavity as in claim 1 comprising at least one plate oriented in such a way that projectiles whose momentum has been arrested within cavity means are directed into a collection means.

5. A bullet trap and containment cavity as in claim 1 further comprising means for removing airborne particulate matter from the cavity.

6. A bullet trap and containment cavity as in claim 1 further comprising means for covering cavity ingress with a permeable covering means through which integral, normal-velocity projectiles may easily pass in, but of sufficient thickness and strength that reflected projectiles will not pass back out.

7. A bullet trap and containment cavity for stopping the forward momentum of projectiles traveling in a generally horizontal zone of projectile travel, said bullet trap and containment cavity comprising:

primary planar impact means oriented generally vertically to directly obstruct the primary zone of projectile travel and fragment projectiles impacting thereon, said fragments reflecting outward in a generally conical zone from the primary point of impact;

secondary planar impact means oriented around the perimeter of, and generally perpendicular to, said primary planar impact means, to obstruct the primary, generally conical zone of projectile travel and further fragment projectiles impacting thereon, said fragments reflecting outward in a secondary generally conical zone from the secondary point of impact;

tertiary planar impact means oriented around the perimeter of, and disposed near the leading edge of said secondary planar impact means, to obstruct components of said secondary generally conical zone of projectile travel whose trajectories are of a direction as to carry them generally toward the point of origin of the original, integral projectile; and wherein the primary planar impact means, secondary planar impact means, and tertiary planar impact means define the perimeter of cavity means to arrest and contain projectiles, said cavity means having an ingress oriented such that projectiles passing through said ingress in a generally horizontal zone will impact upon said primary planar impact means; and said cavity means having egress means for the discharge of projectiles whose inertial momentum has been arrested within the cavity means.

8. A bullet trap and containment cavity as in claim 7 further containing interconnection means whereby multiple like units may be secured together in an array to form a larger total area into which projectiles may be directed.

9. A bullet trap and containment cavity as in claim 7 wherein tertiary planar impact means are oriented such that projectiles missing said cavity ingress and striking the planar surface of said tertiary impact means on the side opposite that used for obstructing tertiary impacts, will be directed toward the ingress of said cavity means.

10. A bullet trap and containment cavity as in claim 7 further containing a collection means disposed under and communicating with cavity egress and comprising a collection tray.

11. A bullet trap and containment cavity as in claim 7 further containing a collection means disposed under and communicating with cavity egress and comprising a conveyor means to move projectiles toward a single location where they are all collected in a single container.

12. A bullet trap and containment cavity as in claim 7 further comprising means for removing airborne particulate matter from the cavity.

13. A bullet trap and containment cavity as in claim 12 wherein the removing means comprises means for releasing moisture within the cavity.

14. A bullet trap and containment cavity as in claim 12 further comprising means for exerting negative air pressure on the cavity to remove airborne particulate matter from the cavity and limit escape of airborne particulate matter through the cavity ingress.

15. A bullet trap and containment cavity as in claim 14 further comprising means for covering cavity ingress with a permeable covering means through which integral, normal-velocity projectiles may easily pass in, but of sufficient thickness and strength that reflected projectiles will not pass back out.

16. A bullet trap and containment cavity for stopping the forward momentum of projectiles traveling in a generally horizontal zone of projectile travel, said bullet trap and containment cavity comprising:

primary planar impact means oriented at an angle within 20 degrees of vertical to directly obstruct the primary zone of projectile travel and fragment projectiles impacting thereon, said fragments reflecting outward in a generally conical zone from the primary point of impact;

secondary planar impact means comprising four plates: top, bottom, and two sides, oriented around the perimeter of, generally perpendicular to, and communicating with the perimeter edge of said primary planar impact means, to obstruct the primary, generally conical zone of projectile travel and further fragment projectiles impacting thereon, said fragments reflecting outward in a secondary generally conical zone from the secondary point of impact;

tertiary planar impact means comprising four plates: top, bottom and two sides, oriented around the perimeter of, and communicating with the leading edge of said secondary planar impact means, to obstruct components of said secondary generally conical zone of projectile travel whose trajectories are of a direction as to carry them generally toward the point of origin of the original, integral projectile;

wherein the primary planar impact means, secondary planar impact means, and tertiary planar impact means define the perimeter of cavity means to arrest and contain projectiles, said cavity means having an ingress oriented such that projectiles passing through said ingress in a generally horizontal zone will impact upon said primary planar impact means;

said cavity means having egress means for the discharge of projectiles, whose inertial momentum has been arrested within the cavity means, into a collection means;

wherein the leading surface of said tertiary planar impact means are oriented such that projectiles impacting upon said surface are directed in through said cavity ingress in a generally horizontal zone and will impact upon said primary planar impact means; and further containing interconnection means whereby multiple like units may be secured together in an array to form a larger total area into which projectiles may be directed.

17. A bullet trap and containment cavity as in claim 16 wherein the collection means comprises a conveyor means to move projectiles toward a single location where they are all collected in a single container.

18. A bullet trap and containment cavity,as in claim 16 further comprising means for removing airborne particulate matter from the cavity.

19. A bullet trap and containment cavity as in claim 18 wherein the removing means comprises means for releasing moisture within the cavity.

20. A bullet trap and containment cavity as in claim 18 further comprising means for exerting negative air pressure on the cavity to remove airborne particulate matter from the cavity and limit escape of airborne particulate matter through the cavity ingress.

21. A bullet trap and containment cavity as in claim 16 further comprising means for covering cavity ingress with a permeable covering means through which integral, normal-velocity projectiles may easily pass in, but of sufficient thickness and strength that reflected projectiles will not pass back out.

* * * * *